US010312007B2

(12) United States Patent
Roy et al.

(10) Patent No.: US 10,312,007 B2
(45) Date of Patent: Jun. 4, 2019

(54) INDUCTOR FORMED IN SUBSTRATE

(71) Applicant: Intel Corporation, Santa Clara, CA (US)

(72) Inventors: Mihir K Roy, Chandler, AZ (US); Mathew J Manusharow, Phoenix, AZ (US); Harold Ryan Chase, Mesa, AZ (US)

(73) Assignee: Intel Corporation, Santa Clara, CA (US)

( * ) Notice: Subject to any disclaimer, the term of this patent is extended or adjusted under 35 U.S.C. 154(b) by 233 days.

(21) Appl. No.: 13/711,149

(22) Filed: Dec. 11, 2012

(65) Prior Publication Data

US 2014/0159850 A1 Jun. 12, 2014

(51) Int. Cl.
*H01F 17/00* (2006.01)

(52) U.S. Cl.
CPC . *H01F 17/0013* (2013.01); *H01F 2017/0066* (2013.01)

(58) Field of Classification Search
CPC ..... H01F 5/00; H01F 27/28
USPC ..... 336/200, 232
See application file for complete search history.

(56) References Cited

U.S. PATENT DOCUMENTS 5,945,902 A * 8/1999 Lipkes ..... H01F 17/0013 29/602.1
6,157,285 A * 12/2000 Tokuda et al. ..... 336/200
7,414,506 B2 * 8/2008 Furumiya ..... H01L 23/5227 257/E21.022
2002/0075116 A1 * 6/2002 Peels et al. ..... 336/200
2002/0105788 A1 * 8/2002 Tokuda et al. ..... 361/762
2002/0140539 A1 * 10/2002 Takashima et al. ..... 336/200
2003/0048167 A1 * 3/2003 Inoue ..... H01F 17/0013 336/200
2007/0033798 A1 * 2/2007 Yoshida ..... H01F 17/0013 29/602.1
2008/0197963 A1 * 8/2008 Muto ..... 336/200
2009/0309687 A1 * 12/2009 Aleksov ..... H01F 17/0033 336/200
2011/0285495 A1 * 11/2011 Kumagai ..... 336/200
(Continued)

FOREIGN PATENT DOCUMENTS

CN 1407564 A 4/2003
CN 103872010 A 7/2014
JP 06333742 A * 12/1994
(Continued)

OTHER PUBLICATIONS

"Korean Application Serial No. 10-2013-153930, Final Office Action dated Jun. 8, 2015", W/ English Translation, 6 pgs.
(Continued)

*Primary Examiner* — Tszfung J Chan
(74) *Attorney, Agent, or Firm* — Schwegman Lundberg & Woessner, P.A.

(57) ABSTRACT

A method and device includes a first conductor formed on a first dielectric layer as a partial turn of a coil. A second conductor is formed on a second dielectric layer that covers the first dielectric layer and first conductor, the second conductor forming a partial turn of the coil. A vertical interconnect couples the first and second conductors to form a first full turn of the coil. The interconnect coupling can be enhanced by embedding some selective magnetic materials into the substrate.

11 Claims, 3 Drawing Sheets

(56) References Cited

U.S. PATENT DOCUMENTS

| | | | | |
|---|---|---|---|---|
| 2013/0082812 | A1* | 4/2013 | Yoo et al. | 336/200 |
| 2014/0251669 | A1 | 9/2014 | Manusharow et al. | |

FOREIGN PATENT DOCUMENTS

| | | | | |
|---|---|---|---|---|
| JP | 6333742 | A | | 12/1994 |
| JP | 888122 | A | | 4/1996 |
| JP | 10335143 | A | | 12/1998 |
| JP | 2005175216 | A | * | 6/2005 |
| JP | 2005175216 | A | | 6/2005 |
| JP | 2007281025 | A | | 10/2007 |
| KR | 20020036756 | A | | 5/2002 |
| KR | 101583222 | B1 | | 1/2016 |
| TW | 201238422 | A | | 9/2012 |
| TW | 201247074 | A | | 11/2012 |

OTHER PUBLICATIONS

"Korean Application Serial No. 10-2013-153930, Non-Final Office Action dated Nov. 25, 2015", W/ English Translation, 12 pgs.
"Korean Application Serial No. 10-2013-153930, Response filed Jan. 25, 2015 to Non-Final Office Action dated Nov. 28, 2015", W/ English Claims, 13 pgs.
"Taiwanese Application Serial No. 102144201, Office Action dated May 8, 2015", W/ English Search Report, 14 pgs.
"Taiwanese Application Serial No. 102144201, Office Action dated Nov. 3, 2014", W/ English Search Report, 12 pgs.
"Taiwanese Application Serial No. 102144201, Response filed Apr. 30, 2015 to Office Action dated Nov. 3, 2014", W/ English Claims, 12 pgs.
"Chinese Application Serial No. 201310757157.4, Decision of Rejection dated Sep. 19, 2016", w/English Claims, 12 pgs.
"Chinese Application Serial No. 201310757157.4, Office Action dated Feb. 22, 2016", w/English Translation, 20 pgs.
"Chinese Application Serial No. 201310757157.4, Office Action dated May 11, 2016", w/English Translation, 23 pgs.
"Chinese Application Serial No. 201310757157.4, Response filed Apr. 20, 2016 Office Action dated Feb. 22, 2016", w/English Claims, 14 pgs.
"Chinese Application Serial No. 201310757157.4, Response filed Jul. 25, 2016 to Office Action dated May 11, 2016", w/English Claims, 12 pgs.
"Taiwanese Application Serial No. 102144201 Office Action dated Nov. 19, 2015", w/English Claims, 17 pgs.
"Taiwanese Application Serial No. 102144201, Office Action dated Jun. 7, 2016", w/English Translation, 17 pgs.
"Taiwanese Application Serial No. 102144201, Response filed Feb. 10, 2017 to Office Action dated Jun. 7, 2016", w/English Claims, 13 pgs.
"Taiwanese Application Serial No. 102144201, Response filed May 20, 2016 to Office Action dated Nov. 19, 2015", w/English Claims, 26 pgs.
"Chinese Application Serial No. 201310757157.4, Response filed Sep. 18, 2017 to Notice of Reexamination dated Aug. 2, 2017", w/ English Claims, 13 pgs.
"Taiwanese Application Serial No. 102144201, Response filed Oct. 17, 2017 to Office Action dated Jul. 19, 2017", w/ English Translation, 37 pgs.

* cited by examiner

INDUCTOR FORMED IN SUBSTRATE

BACKGROUND

Current organic substrates are formed in a symmetric process that results in metal and dielectric layers fabricated on both sides of a core material. As layers are being fabricated, layers fabricated at the same time have the same thickness, including copper layers used to form patterned conductors. Inductors formed of copper, are inherent limiters from a power delivery perspective. Making copper lines thinner to achieve a greater inductance, also increases the resistance of the lines, further decreasing performance relative to power delivery.

One proposed solution is to utilize discrete component inductors, which will reduce dependents on thinner copper conductors. However, such discrete components will not address the ability to deliver power to other power planes in a substrate.

SUMMARY

A device includes a first conductor formed on a first dielectric layer as a partial turn of a coil. A second conductor is formed on a second dielectric layer that covers the first dielectric layer and first conductor, the second conductor forming a partial turn of the coil. A vertical interconnect couples the first and second conductors to form a first full turn of the coil.

A method includes forming a first layer, forming a first partial turn of a coil on the first layer, building up a second dielectric layer over the first layer and first partial turn of the coil, forming a conductive vertical interconnect through the second dielectric layer to the first partial turn of the coil, and forming a second partial turn of the coil on the second dielectric layer coupled to the first partial turn via the conductive vertical interconnect to form a complete turn of the coil.

A device includes a first copper conductor formed on a first dielectric layer as a partial turn of a coil. A second copper conductor is formed on a second dielectric layer that covers the first dielectric layer and first conductor, the second conductor forming a partial turn of the coil. A copper vertical interconnect couples the first and second conductors to form a first full turn of the coil. An ultra-thin core supports the dielectric layers and conductors on a first side of the ultra-thin core. A magnetic core is disposed within the first full turn of the coil.

DETAILED DESCRIPTION

In the following description, reference is made to the accompanying drawings that form a part hereof, and in which is shown by way of illustration specific embodiments which may be practiced. These embodiments are described in sufficient detail to enable those skilled in the art to practice the invention, and it is to be understood that other embodiments may be utilized and that structural and electrical changes may be made without departing from the scope of the present invention. The following description of example embodiments is, therefore, not to be taken in a limited sense, and the scope of the present invention is defined by the appended claims.

Figure 1:
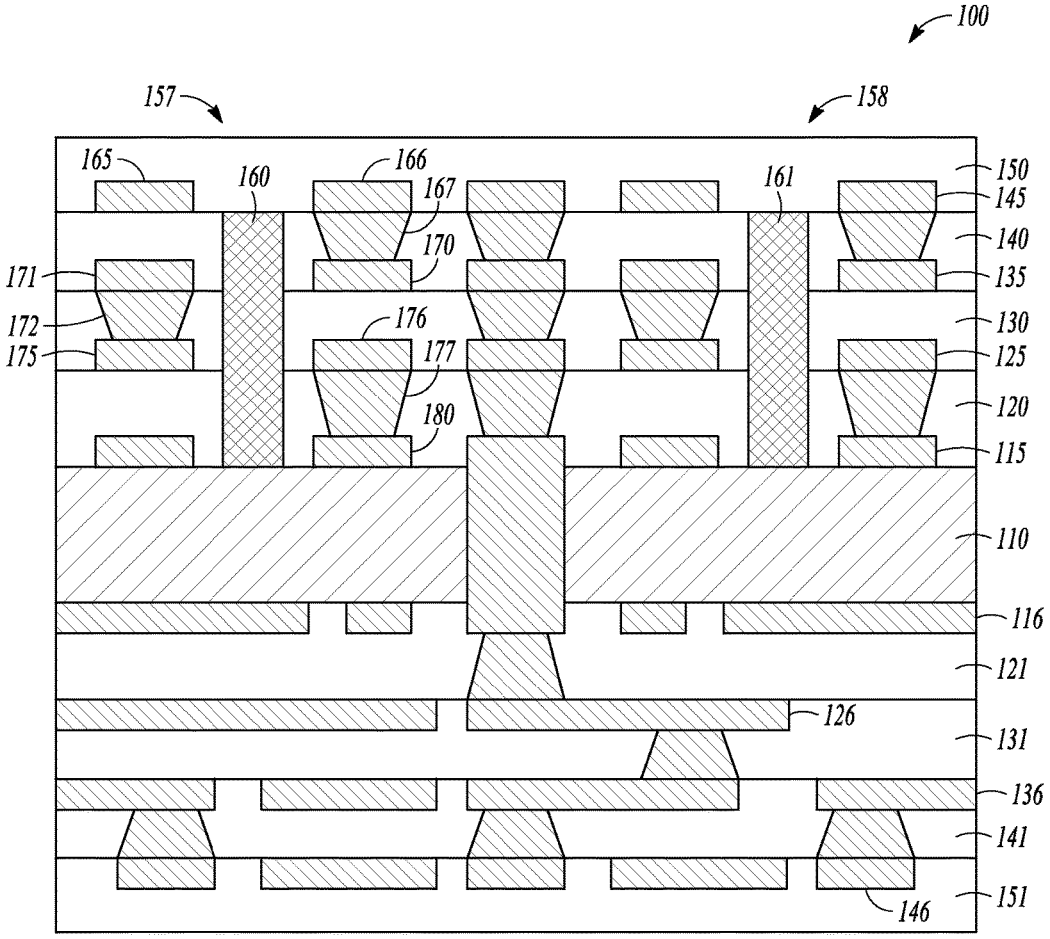
FIG. 1 is a block diagram of a substrate having embedded inductors according to an example embodiment.

FIG. 1 is a cross section schematic view of an organic substrate 100 having multiple layers. In one embodiment, the substrate 100 is formed with an ultra thin core 110, having multiple symmetric layers built up on both sides of the core. In one embodiment, the core 110 is formed of glass reinforced resin. The entire substrate 100 in one embodiment may be formed symmetrically, with multiple layers added to both sides of the core 110 in a semi additive process. The core 110 in one embodiment is patterned on both sides with conductor patterns as indicated at 115 and 116. Dielectric layers 120 and 121 are then formed, followed by additional conductor patterns 125,126, dielectric layers 130, 131, conductor patterns 135,136, dielectric layers 140, 141, conductor patterns 145, 146 and dielectric layers 150, 151. In one embodiment, the core and dielectric layers are all formed of organic materials, with the conductors formed of metal such as copper, or other highly conductive material compatible with the organic dielectric layers.

On a top side 155 of the substrate 100, two multiple turn inductors 157, 158 are formed from multiple partial turns on successive dielectric layers coupled by through hole conductors to form full or complete turns of the inductor. In one embodiment, each inductor has an optional corresponding magnetic core 160, 161 formed of a material of high magnetic permittivity embedded into the substrate that serves to increase the inductance of each inductor. The magnetic materials may for example be dispersed in epoxy resin embedded in the substrate. In one embodiment, the magnetic core is barium titanate $BaTiO_3$ a ferroelectric ceramic material. Other magnetic materials, such as ferrite, may also be used. In further embodiments, the magnetic core is not included, leaving such inductors as air core inductors. The structure of one of the inductors will now be described in detail, starting from a top of the substrate 100 for convenience. Note that during manufacture, the inductors may be formed from the core 110 outward.

Inductor 157 includes a first partial turn indicated at 165 and 166, which may correspond to ends of the first partial turn. The first partial turn 165, 166 is supported on dielectric layer 140. In one embodiment, partial turns may extend 180 or so degrees forming one half of a square or rectangular pattern. Other patterns formable given the processing techniques utilized may also be formed.

At end 166, a conductive through hole is formed through dielectric layer 140 for a vertical interconnect 167 to a second partial turn indicated with ends 170, 171 supported by dielectric layer 130. Vertical interconnect 167 connects end 166 of the first partial turn to end 170 of the second partial turn. The second partial turn essentially completes a first full turn of the inductor as would be seen from a top view, with the magnetic core 160 extending through the full turn toward the cure 110.

A second full turn of the inductor is formed in the same manner, with a vertical interconnect 172 extending through dielectric layer 130 to a third partial turn identified by ends 175, 176. A vertical interconnect 177 extends from end 176 through dielectric layer 120 to a fourth partial turn identified by ends 180 and 181. End 181 is the end of one example inductor and may be coupled to other circuitry via conductive patterning on the core 110.

In further embodiments, more partial turns may be added on further dielectric layers to form higher inductance inductors as desired and permitted by the overall design parameters of the substrate 100. The number of full turns may range from one to many more than two turns, such as three, four, or more, space permitting. Taps may extend from any partial turn of the inductor via conductor patterning on each dielectric layer. Still further, the inductor partial turns may begin or end on layers above the core, or on lower dielectric layers than layer 140. The use of such partial turns separated by dielectric layers provides for scalability of substrate Z-height and a scalability path for inductors without sacrificing copper thickness along with finer line and spacing and design rule modulations. Integration of magnetic material will help in preventing rapid scaling of vertical interconnects, which can be a limiter for maximum through hole current. Optional magnetic cores help make up for loss of inductance loss due to the use of fewer turns to reduce Z-height. An optional dual surface finish allows for using lower generation design rules for the substrate.

A bottom side of substrate 100, including dielectric layers 121, 131, 141, and 151 may include many different conductive patterns and vertical interconnects as indicated.

Figure 2:
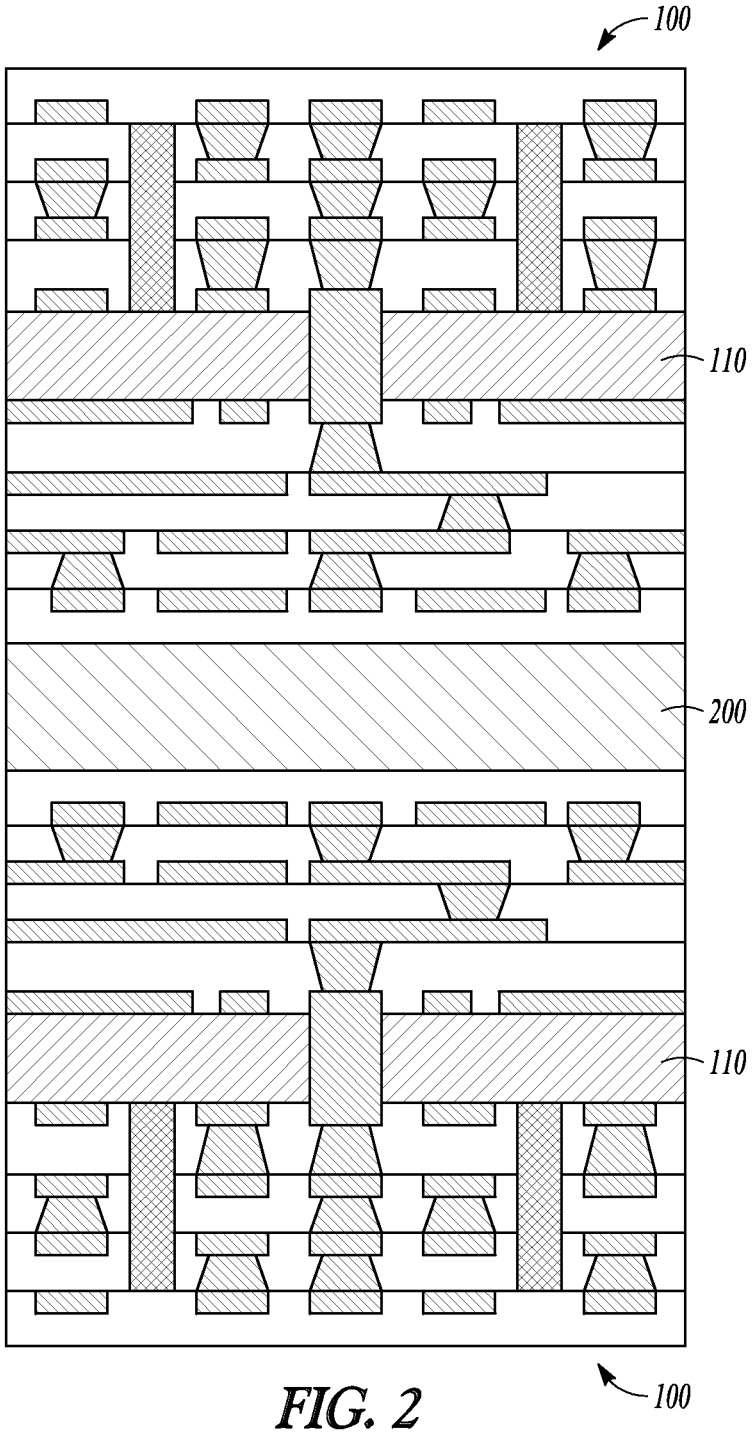
FIG. 2 is a block diagram of two substrates, separated by a sacrificial core, having embedded inductors according to an example embodiment.
Figure 3:
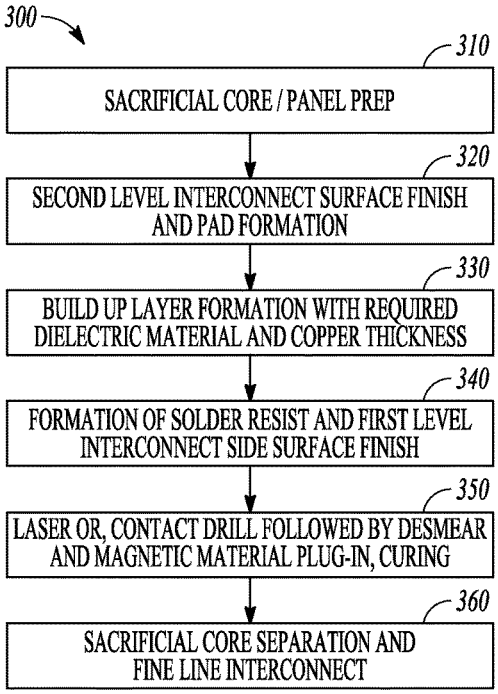
FIG. 3 is a process flow diagram illustrating formation of a substrate having embedded inductors according to an example embodiment.

A schematic cross section of a package on a sacrificial core 200 is shown in FIG. 2. In this embodiment, a substrate manufacturing process begins with the sacrificial core, and builds up first level interconnect layers symmetrically with respect to the sacrificial core 200, forming two versions of substrate 100 having ultra thin cores 110 as shown using build up processes. The ultra thin core formed of one or multiple layers of either pre-peg or ABF with glass cloth may be applied, or a laminated type core build up depending on the needed thickness. Second level interconnects may also be built up. After the build up of dielectric layers for the second level interconnect side that make up the built in inductors, openings for the cores 160, 161 of the inductors may be drilled out via laser or mechanical drill on both sides. Then the core holes may be desmeared and filled with plugging material having a magnetic material as a primary filler via a squeegee type process. The magnetic material may be selected for its permeability and cost, taking into account any package reliability concerns. The plugging material may be cured and panels ground to insure flatness before subsequent metal application and patterning of the last metal layer of the substrate 100, and second level interconnects. A magnetic domain alignment step could also be performed prior to plugging material cure. An example process flow is depicted in block flow form at 300 in FIG. 3 utilizing a sacrificial core and building up the second level interconnect layers first. A sacrificial core is formed and prepped at 310, followed by formation of second level interconnect layer surface finish and pad formation at 320. Build up layer formation then occurs at 330 with dielectric material and copper patterning and interconnects having selected thickness to obtain desired conductive properties suitable for formation of inductors. At 340, solder resist and first level interconnect layer side surface finish is then formed. At 350, a laser or contact drill is done to form openings for an optional magnetic core. A desmear may be done along with magnetic domain alignment in some embodiments and curing of the magnetic material. At 360, the sacrificial core may be separated, and fine line formation using fine size solder balls to couple to a die and package.

Figure 4:
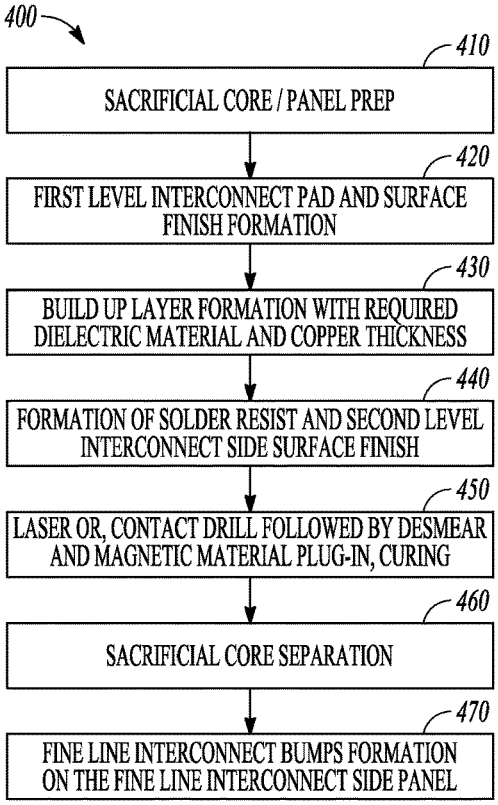
FIG. 4 is a process flow diagram illustrating an alternative process for forming substrate having embedded inductors according to an example embodiment.

An example process flow is depicted in block flow form at 400 in FIG. 4 utilizing a sacrificial core and building up the first level interconnect layers first. A sacrificial core is formed and prepped at 410, followed by formation of first level interconnect layer surface finish and pad formation at 420. Build up layer formation then occurs at 430 with dielectric material and copper patterning and interconnects having selected thickness to obtain desired conductive properties suitable for formation of inductors. At 440, solder resist and second level interconnect layer side surface finish is then formed. At 450, a laser or contact drill is done to form openings for an optional magnetic core. A desmear may be done along with magnetic domain alignment in some embodiments and curing of the magnetic material. At 460, the sacrificial core may be separated. At 470, fine line and bump formation on the first level interconnect side of the substrate is performed.

EXAMPLES

1. A device comprising:
   a first conductor formed on a first dielectric layer as a partial turn of a coil;
   a second conductor formed on a second dielectric layer that covers the first dielectric layer and first conductor, the second conductor forming a partial turn of the coil; and
   a vertical interconnect coupling the first and second conductors to form a first full turn of the coil.
2. The device of example 1 and further comprising a magnetic core disposed within the first full turn of the coil.
3. The device of example 2 wherein the magnetic core has domains aligned.
4. The device of any of examples 2-3 and further comprising two additional partial turn conductors on additional dielectric layers coupled to form a second full turn of the coil.
5. The device of example 4 wherein the magnetic core comprises high magnetic permittivity material particles dispersed in epoxy resin embedded in the substrate.
6. The device of any of examples 1-5 wherein the conductors comprise copper traces.
7. The device of any of examples 1-6 wherein the vertical interconnect comprises copper.
8. The device of any of examples 1-7 and further comprising an ultra-thin core supporting the dielectric layers and conductors on a first side of the ultra-thin core.
9. The device of any of examples 1-8 wherein a symmetric set of dielectric layers are supported on a second side of the ultra-thin core.
10. The device of example 9 and further comprising a sacrificial core supporting the symmetric set of dielectric layers on a first side, and a second symmetric set of dielectric layers and conductors on a second side of the sacrificial core.
11. The device of any of examples 9-10 and further comprising a conductive vertical interconnect through multiple dielectric layers through the ultra-thin core.
12. A device comprising:
    a first copper conductor formed on a first dielectric layer as a partial turn of a coil;
    a second copper conductor formed on a second dielectric layer that covers the first dielectric layer and first conductor, the second conductor forming a partial turn of the coil;

a copper vertical interconnect coupling the first and second conductors to form a first full turn of the coil;

an ultra-thin core supporting the dielectric layers and conductors on a first side of the ultra-thin core; and a magnetic core disposed within the first full turn of the coil.

13. The device of example 12 wherein the magnetic core has domains aligned.

14. The device of any of examples 12-13 and further comprising two additional partial turn conductors on additional dielectric layers coupled to form a second full turn of the coil.

15. The device of example 14 wherein the magnetic core comprises comprises high magnetic permittivity material particles dispersed in epoxy resin embedded in the substrate.

16. The device of any of examples 12-15 and further comprising a sacrificial core supporting the symmetric set of dielectric layers and ultra-thin core on a first side, and a second symmetric set of dielectric layers, ultra-thin core, and conductors on a second side of the sacrificial core.

17. A method comprising:

forming a first layer;

forming a first partial turn of a coil on the first layer;

building up a second dielectric layer over the first layer and first partial turn of the coil;

forming a conductive vertical interconnect through the second dielectric layer to the first partial turn of the coil; and forming a second partial turn of the coil on the second dielectric layer coupled to the first partial turn via the conductive vertical interconnect to form a complete turn of the coil.

18. The method of example 17 and further comprising forming a magnetic core disposed within the complete turn of the coil.

19. The method of example 18 and further comprising magnetically aligning and curing magnetic material to form the magnetic core.

20. The method of any of examples 17-19 and further comprising forming two additional partial turns on additional dielectric layers coupled to form an additional complete turn of the coil.

21. The method of example 20 and further comprising forming a magnetic core disposed within the complete turns of the coil.

22. The method of example 21 and further comprising magnetically aligning and curing magnetic material to form the magnetic core.

23. The method of any of examples 17-22 wherein the conductors and vertical interconnects comprise copper traces.

24. The method of any of examples 17-22 and wherein the first layer comprises an ultra-thin core supporting dielectric layers and partial turns.

Although a few embodiments have been described in detail above, other modifications are possible. For example, the logic flows depicted in the figures do not require the particular order shown, or sequential order, to achieve desirable results. Other steps may be provided, or steps may be eliminated, from the described flows, and other components may be added to, or removed from, the described systems. Other embodiments may be within the scope of the following claims.

The invention claimed is:

1. A device comprising:

a first conductor formed on a first dielectric layer as a partial turn of a coil;

a second conductor formed on a second dielectric layer that covers the first dielectric layer and first conductor, the second conductor forming a partial turn of the coil;

a vertical interconnect coupling the first and second conductors to form a first full turn of the coil;

an ultra-thin core supporting the dielectric layers and conductors on a first side of the ultra-thin core;

a single magnetic core disposed within the first full turn of the coil, wherein the magnetic core includes magnetic material dispersed in an epoxy resin, wherein the magnetic domains are aligned; and a fine line formation on the first dielectric layer using fine solder balls to couple to a die.

2. The device of claim 1 and further comprising two additional partial turn conductors on additional dielectric layers coupled to form a second full turn of the coil.

3. The device of claim 2 wherein the magnetic core comprises high magnetic permittivity material particles dispersed in epoxy resin.

4. The device of claim 1 wherein the conductors comprise copper traces.

5. The device of claim 1 wherein the vertical interconnect comprises copper.

6. The device of claim 1 wherein a second set of dielectric layers symmetric in number and thickness are supported on a second side of the ultra-thin core.

7. The device of claim 6 and further comprising a core supporting the symmetric set of dielectric layers on a first side, and a second symmetric set of dielectric layers and conductors on a second side of the core.

8. The device of claim 6 and further comprising a conductive vertical interconnect through multiple dielectric layers through the ultra-thin core.

9. A device comprising:

a first copper conductor formed on a first dielectric layer as a partial turn of a coil;

a second copper conductor formed on a second dielectric layer that covers the first dielectric layer and first conductor, the second conductor forming a partial turn of the coil;

a copper vertical interconnect coupling the first and second conductors to form a first full turn of the coil;

an ultra-thin core supporting the dielectric layers and conductors on a first side of the ultra-thin core;

a single magnetic core disposed within first full turn of the coil, wherein the magnetic core includes magnetic material dispersed in an epoxy resin, wherein the magnetic domains are aligned; and a fine line formation on the first dielectric layer using fine solder balls to couple to a die.

10. The device of claim 9 and further comprising two additional partial turn conductors on additional dielectric layers coupled to form a second full turn of the coil.

11. The device of claim 10 wherein the magnetic core comprises high magnetic permittivity material particles dispersed in epoxy resin.

* * * * *